US009919438B2

(12) United States Patent
Knapp

(10) Patent No.: US 9,919,438 B2
(45) Date of Patent: Mar. 20, 2018

(54) PERSONAL GROOMING ASSEMBLY

(71) Applicant: Dave Knapp, Kalmazoo, MI (US)

(72) Inventor: Dave Knapp, Kalmazoo, MI (US)

( * ) Notice: Subject to any disclaimer, the term of this patent is extended or adjusted under 35 U.S.C. 154(b) by 22 days.

(21) Appl. No.: 15/014,703

(22) Filed: Feb. 3, 2016

(65) Prior Publication Data

US 2017/0217032 A1 Aug. 3, 2017

(51) Int. Cl.
*B26B 19/44* (2006.01)
*B26B 19/38* (2006.01)

(52) U.S. Cl.
CPC ..... *B26B 19/44* (2013.01); *B26B 19/3873* (2013.01)

(58) Field of Classification Search
CPC ..... B26B 19/44; B26B 19/3873
See application file for complete search history.

(56) References Cited

U.S. PATENT DOCUMENTS 3,369,294 A * 2/1968 Shaw ..... B26B 19/40 30/346.51
3,611,566 A * 10/1971 Brennan, Sr. ..... B26B 19/382 30/41.5
3,634,935 A * 1/1972 Battigalli ..... B26B 19/44 30/41.5
3,828,430 A * 8/1974 Yamada ..... B26B 19/44 15/349
3,905,099 A * 9/1975 Bernstrom ..... B26B 19/44 30/34.1
4,030,196 A * 6/1977 Koiwa ..... B26B 19/44 30/133
4,150,483 A * 4/1979 Kanazawa ..... B26B 19/44 132/213
4,219,931 A 9/1980 Vacilotto
5,031,320 A 7/1991 Persyn
5,060,380 A * 10/1991 Fujikawa ..... B26B 19/28 30/200
5,075,971 A 12/1991 McCambridge
5,394,611 A * 3/1995 Okabe ..... B26B 19/14 30/41.6
5,724,736 A * 3/1998 Smith ..... B26B 19/44 30/133
6,442,842 B1 9/2002 Parry et al.
D472,674 S 4/2003 Long et al.
6,948,248 B2 * 9/2005 Andis ..... B26B 19/02 30/195
7,076,878 B2 7/2006 Degregorio, Jr.
7,114,257 B1 10/2006 Ortega
2002/0108255 A1 * 8/2002 Degregorio, Jr. ..... B26B 19/44 30/133
2017/0217032 A1 * 8/2017 Knapp ..... B26B 19/44

FOREIGN PATENT DOCUMENTS

WO WO 2008/032279 A1 * 3/2008

* cited by examiner

*Primary Examiner* — Hwei C Payer

(57) ABSTRACT

A personal grooming assembly facilitates shaving a user's head. The assembly includes a housing that may be gripped thereby facilitating the housing to be positioned on the user's body. A clipping unit is movably coupled to the housing. The clipping unit cuts hair when the housing is positioned on the user's body. A vacuum unit is coupled to the housing to vacuum hair clippings when the hair is cut. Thus, the hair clippings are removed from the user's body.

8 Claims, 3 Drawing Sheets

PERSONAL GROOMING ASSEMBLY

BACKGROUND OF THE DISCLOSURE

Field of the Disclosure

The disclosure relates to grooming devices and more particularly pertains to a new grooming device for shaving a user's head.

SUMMARY OF THE DISCLOSURE

An embodiment of the disclosure meets the needs presented above by generally comprising a housing that may be gripped thereby facilitating the housing to be positioned on a user's body. A clipping unit is movably coupled to the housing. The clipping unit cuts hair when the housing is positioned on the user's body. A vacuum unit is coupled to the housing to vacuum hair clippings when the hair is cut. Thus, the hair clippings are removed from the user's body.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
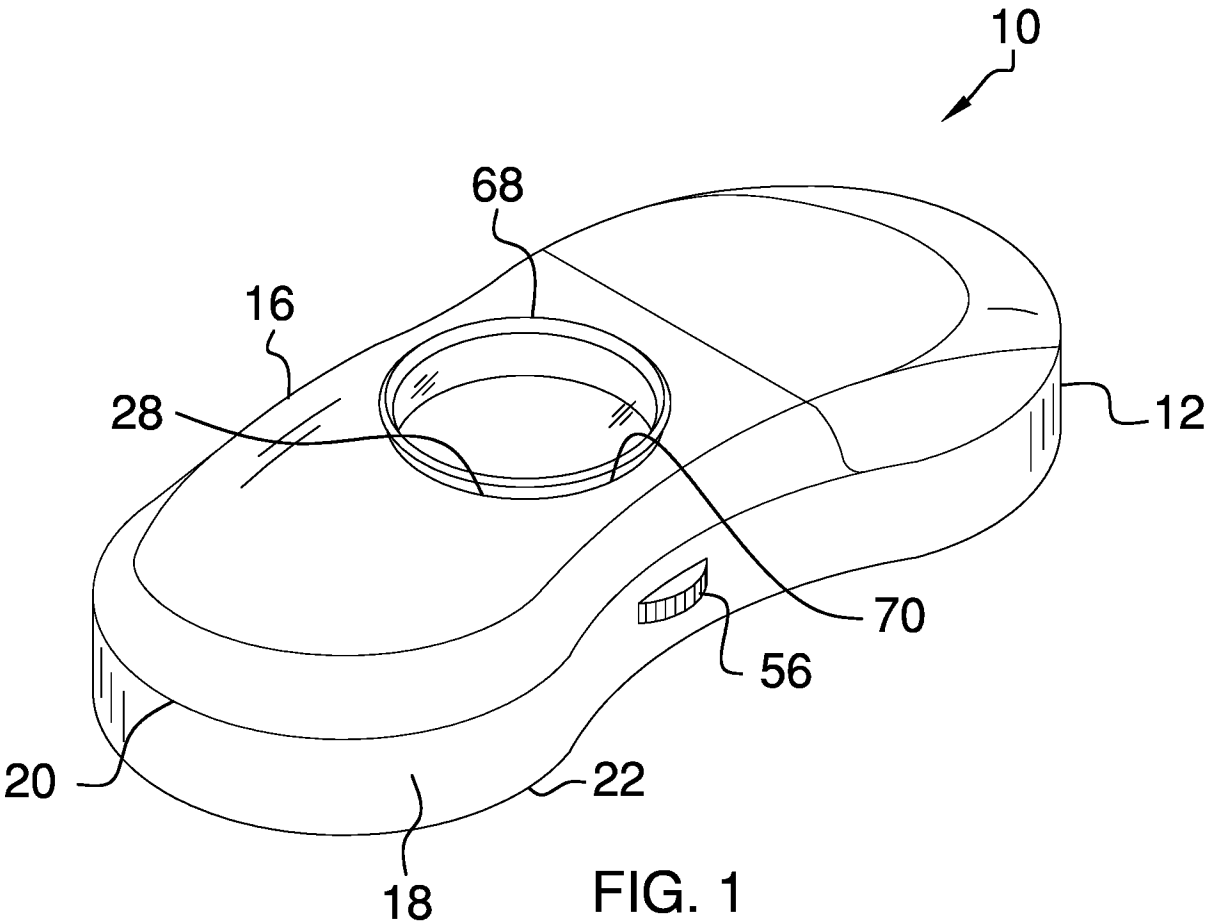
FIG. 1 is a top perspective view of a personal grooming assembly according to an embodiment of the disclosure.
Figure 2:
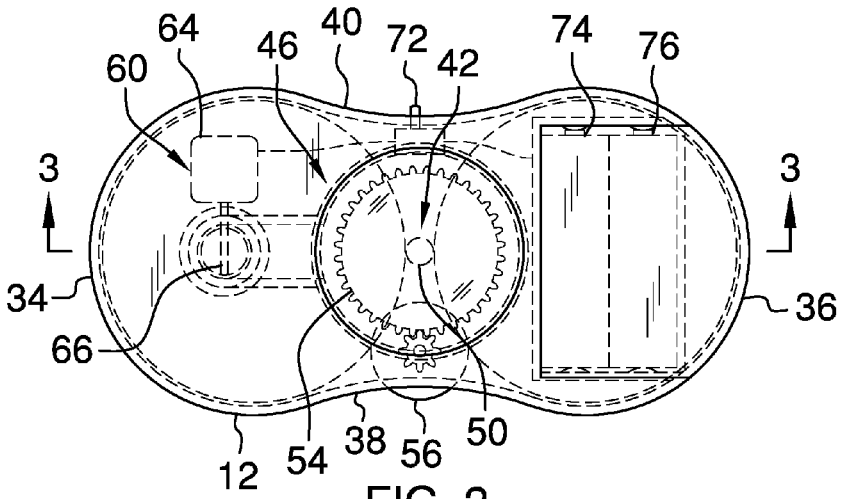
FIG. 2 is a top phantom view of an embodiment of the disclosure.
Figure 3:
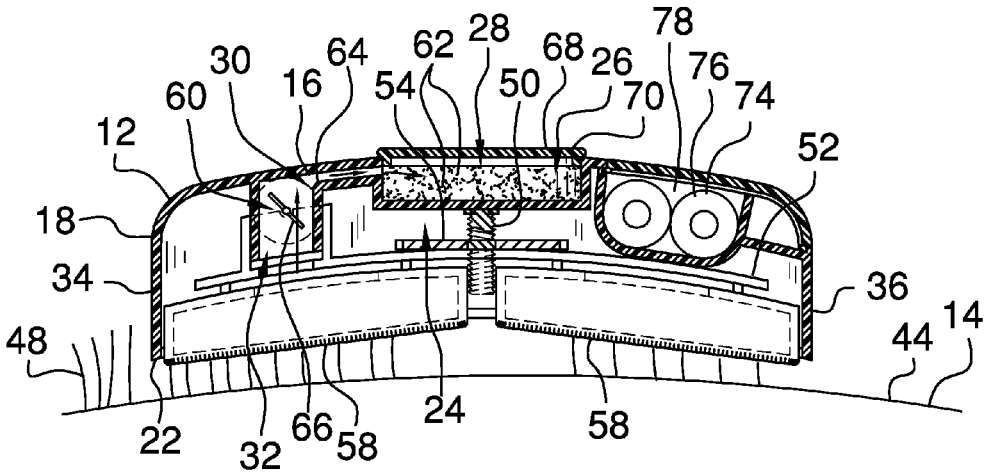
FIG. 3 is a cross sectional view taken along line 3-3 of FIG. 2 of an embodiment of the disclosure.
Figure 4:
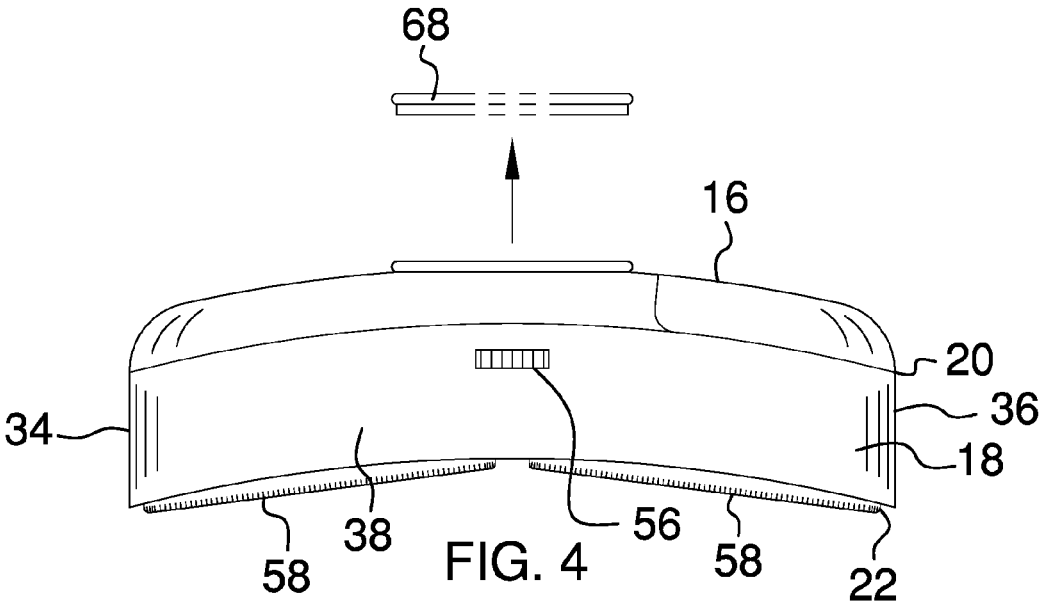
FIG. 4 is a front view of an embodiment of the disclosure.
Figure 5:
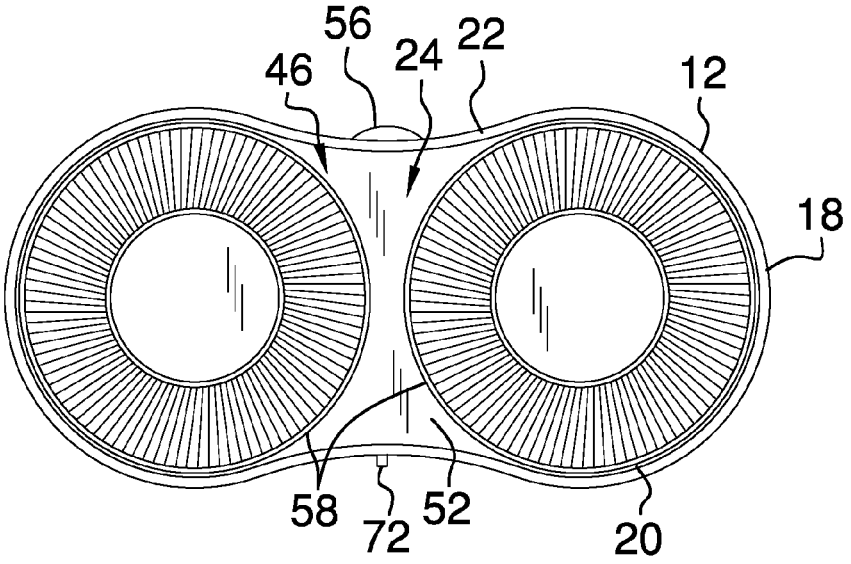
FIG. 5 is a bottom view of an embodiment of the disclosure.

With reference now to the drawings, and in particular to FIGS. 1 through 5 thereof, a new grooming device embodying the principles and concepts of an embodiment of the disclosure and generally designated by the reference numeral 10 will be described.

As best illustrated in FIGS. 1 through 5, the personal grooming assembly 10 generally comprises a housing 12 that may be gripped. The housing 12 may be positioned on a user's body 14. The housing 12 has a top wall 16 and a peripheral wall 18 extending downwardly from the top wall 16. The peripheral wall 18 is coextensive with an outer edge 20 of the top wall 16. The peripheral wall 18 has a distal edge 22 with respect to the top wall 16. The distal edge 22 defines an opening 24 into the housing 12.

A chamber 26 is positioned on the top wall 16 and the top wall 16 has an opening 28 extending into the chamber 26. A conduit 30 is fluidly coupled to the chamber 26. The conduit 30 has a distal end 32 with respect to the chamber 26 and the distal end 32 is open. A battery compartment 78 is positioned in the opening 28.

The peripheral wall 18 has a first lateral side 34, a second lateral side 36, a front side 38 and a back side 40. The housing 12 is elongated between the first lateral side 34 and the second lateral side 36. Each of the front side 38 and the back side 40 may curve inwardly toward a center 42 of the housing 12. Thus, the housing 12 may have a kidney shape thereby enhancing gripping the housing 12. The top wall 16 may be convexly arcuate between the first lateral side 34 and the second lateral side 36. Thus, the distal edge 22 of the housing 12 may follow a curve of the user's head 44.

A clipping unit 46 is provided and the clipping unit 46 is movably coupled to the housing 12. The clipping unit 46 cuts hair 48 on the user's body 14 when the housing 12 is positioned on the user's body 14. The clipping unit 46 comprises a screw 50 coupled to and extending away from the top wall 16. The screw 50 is centrally positioned within the opening 24.

A plate 52 is provided and the screw 50 extends through the plate 52. The plate 52 may be elongated between the first lateral side 34 and the second lateral side 36 of the housing 12. The plate 52 is spaced from the top wall 16. The plate 52 may be curved such that the plate 52 is co-arcuate with the top wall 16. The distal end 32 of the conduit 30 is in fluid communication with the plate 52. A gear 54 is rotatably coupled to the plate 52 and the screw 50 threadably engages the gear 54. The gear 54 moves upwardly and downwardly along the screw 50 when the gear 54 is rotated.

A dial 56 is rotatably coupled to the housing 12. The dial 56 extends outwardly from the peripheral wall 18 and the dial 56 may be manipulated. The dial 56 engages the gear 54. Thus, the dial 56 rotates the gear 54 when the dial 56 is manipulated. The dial 56 may be centrally positioned on the front side 38 of the housing 12.

A pair of clipping heads 58 is provided. Each of the clipping heads 58 is movably coupled to the plate 52. Each of the clipping heads 58 extends outwardly from the opening 24. Thus, each of the clipping heads 58 may cut the hair 48 on the user's body 14. Each of the clipping heads 58 is in fluid communication with the conduit 30.

The clipping heads 58 are spaced apart from each other and are distributed between the first lateral side 34 and the second lateral side 36. Thus, each of the clipping heads 58 is positioned at an angle with respect to each other. Each of the clipping heads 58 is tiltable about an axis extending through the top wall 16 and the distal edge 22. The angled relationship between the clipping heads 58 facilitates the clipping heads 58 to follow a curve of the user's head 44. Each of the clipping heads 58 may comprise a rotary electric shaver or the like.

A vacuum unit 60 is coupled to the housing 12. The vacuum unit 60 vacuums hair clippings 62 when the hair 48 is cut. Thus, the hair clippings 62 are removed from the user's body 14. The vacuum unit 60 comprises a motor 64 that is coupled to the housing 12. The motor 64 may comprise an electric motor or the like.

A fan 66 is rotatably coupled to the motor 64 and the motor 64 rotates the fan 66 when the motor 64 is turned on. The fan 66 is positioned within the conduit 30 and the fan 66 urges air between the conduit 30 and the chamber 26. The fan 66 draws air over each of the clipping heads 58. Thus, the fan 66 suctionally urges the hair clippings 62 into the chamber 26.

A lid 68 is removably coupled to the top wall 16. The opening 28 has a bounding surface 70 and the lid 68 may theadably engage the bounding surface 70. Thus, the lid 68 covers the opening 28 when the lid 68 is coupled to the top wall 16. The lid 68 retains the hair clippings 62 in the chamber 26.

A switch 72 is coupled to the housing 12. The switch 72 may be positioned on the back side 40 of the housing 12 and the switch 72 may be manipulated. The switch 72 is electrically coupled to each of the clipping heads 58 and the motor 64. A power supply 74 is positioned within the battery compartment 78. The power supply 74 is electrically coupled to the switch 72. The power supply 74 comprises at least one battery 76.

In use, the switch 72 is manipulated to turn the motor 64 on and to turn each of the clipping heads 58 on. The housing 12 is manipulated to position each of the clipping heads 58 against the user's head 44. The clipping heads 58 shave the hair 48 from the user's head 44. The lid 68 is removed and the hair clippings 62 are emptied from the chamber 26. The housing 12 may be positioned on any selected part of the user's body 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A personal grooming assembly comprising:

a housing being configured to be gripped thereby facilitating said housing to be positioned on a user's body, said housing having a top wall and a peripheral wall extending downwardly from said top wall, said peripheral wall being coextensive with an outer edge of said top wall, said peripheral wall having a distal edge with respect to said top wall, said distal edge defining an opening into said housing, said housing having a chamber being positioned on said top wall, said top wall having an opening extending into said chamber, said housing having a conduit being fluidly coupled to said chamber, said conduit having a distal end with respect to said chamber, said distal end being open, said housing having a battery compartment;

a clipping unit being movably coupled to said housing wherein said clipping unit is configured to cut hair when the housing is positioned on the user's body, wherein said clipping unit comprises a screw being coupled to said housing, said screw extending away from said top wall of said housing, said screw being centrally positioned within said opening defined by said distal edge; and a vacuum unit being coupled to said housing wherein said vacuum unit is configured to vacuum hair clippings when the hair is cut thereby inhibiting the hair clippings being left on the user.

2. The assembly according to claim 1, further comprising:

a plate having said screw extending through said plate; and a gear being rotatably coupled to said plate, said screw threadably engaging said gear such that said gear moves upwardly and downwardly along said screw when said gear is rotated.

3. The assembly according to claim 2, further comprising a dial being rotatably coupled to said housing, said dial extending outwardly from said peripheral wall wherein said dial is configured to be manipulated, said dial engaging said gear such that said dial rotates said gear when said dial is manipulated.

4. The assembly according to claim 3, further comprising a pair of clipping heads, each of said clipping heads being movably coupled to said plate, each of said clipping heads extending outwardly from said opening defined by said distal edge wherein each of said clipping heads is configured to cut the hair, each of said clipping heads being in fluid communication with said conduit in said housing.

5. The assembly according to claim 1, further comprising a lid being removably coupled to said top wall, said lid covering said opening extending into said chamber when said lid is coupled to said top wall wherein said lid is configured to retain the hair clippings in said chamber.

6. The assembly according to claim 1, further comprising:

a pair of clipping heads;

a motor; and a power supply being positioned within said battery compartment, said power supply being electrically coupled to each of said clipping heads and said motor, said power supply comprising at least one battery.

7. A personal grooming assembly comprising:

a housing being configured to be gripped thereby facilitating said housing to be positioned on a user's body, said housing having a top wall and a peripheral wall extending downwardly from said top wall, said peripheral wall being coextensive with an outer edge of said top wall, said peripheral wall having a distal edge with respect to said top wall, said distal edge defining an opening into said housing, said housing having a chamber being positioned on said top wall, said top wall having an opening extending into said chamber, said housing having a conduit being fluidly coupled to said chamber, said conduit having a distal end with respect to said chamber, said distal end being open, said housing having a battery compartment;

a clipping unit being movably coupled to said housing wherein said clipping unit is configured to cut hair when the housing is positioned on the user's body;

a vacuum unit being coupled to said housing wherein said vacuum unit is configured to vacuum hair clippings when the hair is cut thereby inhibiting the hair clippings being left on the user; and wherein said vacuum unit comprises:

a motor being coupled to said housing, and a fan being rotatably coupled to said motor such that said motor rotates said fan when said motor is turned on wherein said fan is configured to create suction, said fan being positioned within said conduit wherein said fan is configured to suctionally urge the hair clippings into said chamber.

8. A personal grooming assembly comprising:

a housing being configured to be gripped thereby facilitating said housing to be positioned on a user's body, said housing having a top wall and a peripheral wall extending downwardly from said top wall, said peripheral wall being coextensive with an outer edge of said top wall, said peripheral wall having a distal edge with respect to said top wall, said distal edge defining an opening into said housing, said housing having a chamber being positioned on said top wall, said top wall having an opening extending into said chamber, said housing having a conduit being fluidly coupled to said chamber, said conduit having a distal end with respect to said chamber, said distal end being open, said housing having a battery compartment;

a clipping unit being movably coupled to said housing wherein said clipping unit is configured to cut hair when the housing is positioned on the user's body, said clipping unit comprising:

a screw being coupled to said housing, said screw extending away from said top wall, said screw being centrally positioned within said opening defined by said distal edge, a plate having said screw extending through said plate, a gear being rotatably coupled to said plate, said screw threadably engaging said gear such that said gear moves upwardly and downwardly along said screw when said gear is rotated, a dial being rotatably coupled to said housing, said dial extending outwardly from said peripheral wall wherein said dial is configured to be manipulated, said dial engaging said gear such that said dial rotates said gear when said dial is manipulated, and a pair of clipping heads, each of said clipping heads being movably coupled to said plate, each of said clipping heads extending outwardly from said opening defined by said distal edge wherein each of said clipping heads is configured to cut the hair, each of said clipping heads being in fluid communication with said conduit;

a vacuum unit being coupled to said housing wherein said vacuum unit is configured to vacuum hair clippings when the hair is cut thereby inhibiting the hair clippings being left on the user, said vacuum unit comprising:

a motor being coupled to said housing, and a fan being rotatably coupled to said motor such that said motor rotates said fan when said motor is turned on wherein said fan is configured to create suction, said fan being positioned within said conduit wherein said fan is configured to suctionally urge the hair clippings into said chamber;

a lid being removably coupled to said top wall, said lid covering said opening extending into said chamber when said lid is coupled to said top wall wherein said lid is configured to retain the hair clippings in said chamber; and a power supply being positioned within said battery compartment, said power supply being electrically coupled to each of said clipping heads and said motor, said power supply comprising at least one battery.

* * * * *